US005740783A

United States Patent [19]

Learman et al.

[11] Patent Number: 5,740,783

[45] Date of Patent: Apr. 21, 1998

[54] ENGINE DEMAND FUEL DELIVERY SYSTEM

[75] Inventors: William L. Learman, Caro; Ronald H. Roche, Cass City; Matthew L. Werner, Caro, all of Mich.

[73] Assignee: Walbro Corporation, Cass City, Mich.

[21] Appl. No.: 749,448

[22] Filed: Nov. 15, 1996

Related U.S. Application Data

[63] Continuation of Ser. No. 367,106, Dec. 30, 1994, abandoned.

[51] Int. Cl.[6] ..... F02M 37/04

[52] U.S. Cl. ..... 123/497; 123/456

[58] Field of Search ..... 123/497, 456, 123/359, 357, 358

[56] References Cited

U.S. PATENT DOCUMENTS

| | | | |
|---|---|---|---|
| Re. 34,803 | 12/1994 | Chasteen | 123/73 |
| 3,669,081 | 6/1972 | Monpetit | 123/497 |
| 3,699,931 | 10/1972 | Cinquegrani | 123/497 |
| 3,822,677 | 7/1974 | Reddy | 123/497 |
| 4,260,333 | 4/1981 | Schillingen | 123/497 |
| 4,728,264 | 3/1988 | Tuckey | 417/44 |
| 4,743,171 | 5/1988 | Mahoney | 417/349 |
| 4,765,304 | 8/1988 | Brown | 123/532 |
| 4,779,581 | 10/1988 | Maier | 123/73 |
| 4,789,308 | 12/1988 | Tuckey | 417/44 |
| 4,836,453 | 6/1989 | Poehlman | 239/408 |
| 4,862,857 | 9/1989 | Donohue | 123/534 |
| 4,865,002 | 9/1989 | Borst et al. | 123/532 |
| 4,901,701 | 2/1990 | Chasteen | 123/478 |
| 4,920,942 | 5/1990 | Fujimori | 123/497 |
| 4,926,829 | 5/1990 | Tuckey | 123/497 |
| 4,940,034 | 7/1990 | Heim | 123/497 |
| 4,951,636 | 8/1990 | Tuckey et al. | 123/497 |
| 4,967,712 | 11/1990 | Chasteen | 123/478 |
| 5,016,597 | 5/1991 | Borst | 123/533 |
| 5,044,344 | 9/1991 | Tuckey et al. | 123/497 |
| 5,050,559 | 9/1991 | Korosu et al. | 123/478 |
| 5,050,564 | 9/1991 | Suzuki et al. | 123/492 |
| 5,085,193 | 2/1992 | Morikawa | 123/497 |
| 5,088,464 | 2/1992 | Meaney | 123/478 |
| 5,090,386 | 2/1992 | Kurosu et al. | 123/478 |

(List continued on next page.)

FOREIGN PATENT DOCUMENTS

| | | | |
|---|---|---|---|
| 1072407 | 2/1980 | Canada | 123/31 |
| 1140822 | 2/1983 | Canada | 123/133 |

*Primary Examiner*—Carl S. Miller

*Attorney, Agent, or Firm*—Barnes, Kisselle, Raisch, Choate, Whittemore & Hulbert

[57] ABSTRACT

A fuel delivery system and method for providing fuel to a fuel injected engine using an engine control unit (ECU) to determine engine fuel demand and adjust fuel pump operation accordingly to supply at least as much fuel as demanded by the engine. The ECU determines a fuel pump control signal based upon fuel demand and applies the signal to a fuel pump driver that controllably drives the pump in response to the control signal. The ECU determines fuel demand by monitoring engine operation and calculates a control signal that controls the duration of time the fuel injector stays open during an upcoming intake stroke of engine operation. The pump control signal is proportional to engine fuel demand multiplied by a constant that ensures more fuel will be available for delivery to the injector than demanded by the engine. Engine fuel demand is proportional to the duration of time the injector will stay open multiplied by the engine speed. Preferably, if the calculated pump signal is less than a minimum that would cause the pump to operate below a desired minimum duty cycle, the control signal is set at the minimum to ensure sufficient excess fuel will be available to meet any sharp increases in demand. If the calculated signal is greater than the maximum pump duty cycle, the signal is set at the maximum to avoid damaging the pump. If the calculated signal is between the minimum and maximum limits, the control signal is set to the calculated value.

30 Claims, 3 Drawing Sheets

U.S. PATENT DOCUMENTS

| | | | |
|---|---|---|---|
| 5,091,858 | 2/1992 | Paielli | 364/431.12 |
| 5,120,201 | 6/1992 | Tuckey et al. | 417/366 |
| 5,148,792 | 9/1992 | Tuckey | 123/497 |
| 5,174,263 | 12/1992 | Meaney | 123/478 |
| 5,191,531 | 3/1993 | Kurosu et al. | 364/431.05 |
| 5,257,607 | 11/1993 | Gillespie | 123/478 |
| 5,265,644 | 11/1993 | Tuckey | 137/510 |
| 5,273,016 | 12/1993 | Gillespie | 123/403 |
| 5,287,281 | 2/1994 | Meaney | 364/431.05 |
| 5,309,885 | 5/1994 | Rawlings et al. | 123/509 |
| 5,341,785 | 8/1994 | Meaney | 123/452 |
| 5,343,847 | 9/1994 | Chasteen | 123/527 |
| 5,355,859 | 10/1994 | Weber | 123/497 |
| 5,373,827 | 12/1994 | Rondou | 123/497 |
| 5,377,646 | 1/1995 | Chasteen | 123/527 |

ENGINE DEMAND FUEL DELIVERY SYSTEM

This application is a continuation of application Ser. No. 08/367,106, filed Dec. 30, 1994, now abandoned.

FIELD OF THE INVENTION

This invention relates to a method and apparatus for controlling the delivery of fuel to an internal combustion engine and more particularly to a method and apparatus for delivering fuel as a function of engine fuel demand.

BACKGROUND

In many small engine fuel delivery systems currently in use, fuel is fed by a constant-delivery pump from a fuel tank to the engine, and excess fuel is returned from the engine to the tank. The returned fuel carries engine heat to the fuel supply which can significantly increase the temperature and vapor pressure of the fuel in the tank. Venting fuel vapor to the atmosphere to relieve pressure caused by the heated returned fuel is undesirable because it would release hydrocarbons that are carcinogenic or which can form damaging oxidants such as ozone. Venting is also undesirable because it significantly reduces fuel mileage. When heated, the liquid fuel in the fuel tank can also vapor-lock the fuel pump causing the engine to stop or not start until the fuel in the tank has cooled. Constant fuel pump operation is also undesirable because it increases electrical power consumption while decreasing both pump life and fuel filter life.

Currently, fuel pumps that supply fuel to electronically fuel injected internal combustion small engines are oversized so they always provide an adequate amount of fuel to the engine, even during worst case and maximum load engine operating conditions. These worst case conditions can occur while the engine is operating at wide open throttle such as during hard acceleration or during towing, when heavily loaded, or while climbing a hill having a steep incline. During worst case and maximum load conditions, the engine requires significantly more fuel than while idling and during normal load operation.

Although, it is desirable to supply more fuel to the engine than it is using during operation for maintaining adequate fuel pressure at each injector, oversizing the fuel pump causes the pump to supply significantly more fuel to each injector than is required during idle and normal engine operating conditions. The result is also decreased filter life and increased electrical power consumption.

Unfortunately, particularly for small engine applications, because they utilize relatively small electrical alternator and generator systems, they frequently have insufficient power output at low speeds and increased electrical consumption can detrimentally affect operation by excessively increasing the electrical load on the alternator or generator thereby reducing its life. If electrical power demands exceed the output capacity of the alternator or generator, electrical power will be drawn from the battery to make up the power deficit reducing battery life. With present day electrical power demands rising due to an ever increasing number of convenience devices being powered by the engine, such as convenience lights, head lights, brake lights stereos, compact disc players and cellular phones on motorcycles, fish-locators on boats, and lights, handlebar heaters, engine operation monitoring instruments on snowmobiles, as well as other electric power consuming devices and instruments, every effort is being made by the design engineer to minimize the electrical power consumption of all engine components requiring power.

Attempts have been made to reduce electrical consumption by varying fuel pump output in response to engine demand as sensed by fuel line pressure. This type of fuel delivery system varies the speed of the fuel pump in response to the engine fuel demand and, hence, fuel pressure downstream of the pump thereby lessening electrical power consumption. Representative of this type of fuel delivery system are U.S. Pat. Nos. U.S. Pat. No. 4,728,264 to Tuckey; U.S. Pat. No. 4,789,308 to Tuckeyl U.S. Pat. No. 4,926,829 to Tuckey; U.S. Pat. No. 5,044,344 to Tuckey, et al.; U.S. Pat. No. 5,120,201; to Tuckey; U.S. Pat. No. 5,148,792 to Tuckey; and U.S. Pat. No. 5,265,644 to Tuckey.

However, these systems require at least one additional component, such as a pressure sensor or regulator, that provides an indication of fuel pressure downstream of the fuel pump to vary fuel pump operation. Additionally, these systems can be slow to react because sensing fuel pressure indicates present engine demand, not anticipated future demand. As such, there can be a time lag in delivering a sufficient amount of fuel should fuel demand quickly rise dramatically possibly causing the engine to stumble temporarily until sufficient fuel is supplied by the fuel pump to meet demand.

First Inertia Switch, of Grand Blanc, Mich., makes an add-on fuel pump driver for variably controlling operation of a fuel pump using only the fuel injector operating signal from the engine control unit of an internal combustion engine. This fuel pump driver is used in larger engine, automotive applications and consists of a modular box that houses a fuel pump driver circuit with external wiring connecting the driver to the fuel injector control signal at the fuel injectors and external wiring connecting the driver to the fuel pump. Both sets of external wiring can be susceptible to conducted and radiated electromagnetic interference (EMI) and radio frequency interference (RFI) creating "noise" within the wiring which can undesirably affect fuel pump operation. Furthermore, tapping the fuel injector control signal reduces the signal level possibly negatively affecting fuel injector operation. Additionally, because the engine compartment is crowded and for aesthetic reasons, it is also undesirable to have the fuel pump driver mounted near the engine in relatively close proximity to the fuel injectors.

Although faster in response than the aforementioned pressure sensing fuel delivery system references, the First Inertia fuel pump driver module also adjusts fuel pump output in response to actual demand. Even so, a lag in fuel delivery due to a relatively sharp rise in fuel demand can also occur because the First Inertia driver must first wait for the engine control unit (ECU) to calculate and send the fuel injector control signal to each fuel injector before it can determine and signal the fuel pump how much fuel should be delivered. In some instances, this lag may be significant, particularly when demand steeply rises during full load or wide open throttle conditions, because the First Inertia fuel pump driver module has no way of sensing engine fuel demand any earlier, such as by sensing throttle position, for increasing fuel delivery to coincide with the rise in demand. To compensate for any such time lag in increasing fuel delivery, the fuel pump driver must cause the fuel pump to supply more excess fuel at virtually all other times of operation than it would if it determined engine fuel demand earlier so any rapid increase in demand would not leave the engine without sufficient fuel.

SUMMARY OF THE INVENTION

A fuel delivery system for a fuel injected internal combustion engine wherein operation of the fuel pump is controlled to supply at least as much fuel as is being demanded by the engine while reducing electrical power consumed by the fuel pump. The fuel delivery system has an engine control unit (ECU) that communicates with the engine to predetermine how much fuel the engine will need based upon engine operating parameters, such as engine speed and throttle position, mass airflow entering the engine, and/or engine ignition. This engine fuel demand information is used to determine a fuel pump control signal communicated by the ECU to a fuel pump driver that controllably drives the pump to vary its fuel output in response to the control signal generated by the ECU. Preferably, the fuel pump control signal formulated by the ECU causes the fuel pump driver to vary the duty cycle of the pump to provide as much fuel to each fuel injector of the engine as is being demanded by the engine for maintaining proper fuel pressure at each injector while providing sufficient excess fuel to meet sudden increases in fuel demand. Preferably, there is a fuel pressure regulator downstream of the fuel pump to regulate the pressure of fuel supplied to each injector to ensure each injector meters the desired amount of fuel during its intake stroke of engine operation.

Preferably, the ECU monitors engine operation to determine how much fuel each injector must mix with air entering the engine to ensure efficient engine operation. To do so, the ECU uses the engine fuel demand information to generate a fuel injector driver signal that is sent to each fuel injector for controlling how long each injector will stay open dispensing fuel during its next intake stroke of engine operation.

Preferably, in determining the fuel pump control signal, the ECU multiplies engine speed by the duration that each fuel injector will stay open for determining the rate that fuel should be supplied to the engine to satisfy engine demand. Preferably, to determine how much fuel to supply to the engine in formulating the fuel pump control signal, the resulting calculated fuel demand is further multiplied by a constant chosen to ensure that more fuel will be supplied to the engine than will be consumed by the engine to ensure that the desired fuel pressure at each injector is maintained and that there is sufficient excess fuel to meet any sudden increases in fuel demand. Preferably, the constant is greater than unity so that more fuel is supplied to the engine than demanded. For example, the constant can be chosen so that the fuel pump always supplies at least five-to-ten percent more fuel than is demanded by the engine. Other constants of greater or lesser value may be determined or selected if it is desirable to supply greater or less excess fuel to the engine.

The fuel pump control signal generated by the ECU controls the duty cycle of electrical power supplied by the fuel pump driver to the fuel pump thereby controlling the duty cycle of operation of the fuel pump. Preferably, if the calculated control signal would cause the fuel pump to operate at less than a desired minimum duty cycle, the control signal is automatically set so the pump operates at the desired minimum duty cycle for maintaining fuel pressure at each injector and providing sufficient excess fuel to meet sudden increases in fuel demand. Preferably, the fuel pump control signal is automatically set at a value that would cause the fuel pump to operate at its maximum duty cycle if the calculated value would cause the pump to operate at a level greater than the maximum duty cycle to prevent damaging the pump. The maximum and minimum duty cycle limits may be empirically determined and may vary depending upon the type, size, application, intended operation and use of the fuel pump.

Otherwise, if the calculated fuel pump control signal would result in the pump operating at a duty cycle between the desired minimum and maximum duty cycles, the fuel pump control signal is set equal to the calculated control signal. After the fuel pump control signal is determined, the signal is applied to the fuel pump driver which accordingly adjusts the amount of power supplied to the motor of the fuel pump for varying the duty cycle of fuel pump operation to supply at least as much fuel as demanded by the engine.

Objects, features and advantages of this invention are to provide a fuel delivery system and method for delivering fuel to a fuel injected internal combustion engine that provides at least as much fuel to each injector as is being demanded by the engine to assure an adequate supply of fuel during engine operation while providing a sufficient amount of excess fuel so that each injector has enough fuel to respond to sudden increases in fuel demand, more closely matches fuel pump output to engine fuel demand, more quickly varies fuel pump operation to supply fuel directly in response to engine fuel demand, reduces the amount of electrical power consumed by the fuel pump by varying the duty cycle of the fuel pump in response to the fuel demand of the engine, can adjust the amount of fuel supplied by the fuel pump in response to fuel demand even before the fuel demanded is consumed by the engine, quickly replaces fuel used by the engine, quickly responds to sudden increases in fuel demand because the electronic control unit determines both the fuel injector control signal and fuel pump control signal based upon the same engine fuel demand information, enables fuel injection and high pressure fuel pumps to be used on engines only having a magneto or generator for supplying electrical power, ensures that the fuel pump is always operating at a minimum duty cycle so that a sufficient amount of excess fuel is available to each fuel injector for responding to sudden increases in engine fuel demand, ensures that the fuel pump is never operated at a duty cycle greater than its maximum duty cycle to prevent damage to the pump, can be used with systems designed for use without a battery, enables the ECU to independently control fuel pump operation independently of the fuel injector driver signal, permits the ECU flexibly control operation of the fuel pump during different periods of engine operation including engine startup, idle, part load and full load operating conditions, enables the ECU to control fuel pump operation based on actual engine operation to provide more precise control of fuel pump output, is of simple and economical construction required for small engine applications and is versatile being well suited for use with both two-stroke and four-stroke engines, and, is reliable, flexible, durable and of simple and compact design, rugged construction, and economical manufacture.

BRIEF DESCRIPTION OF THE DRAWINGS

These and other objects, features and advantages of this invention will be apparent from the following detailed description of the best mode, appended claims and accompanying drawings in which:

DETAILED DESCRIPTION OF THE INVENTION

Figure 1:
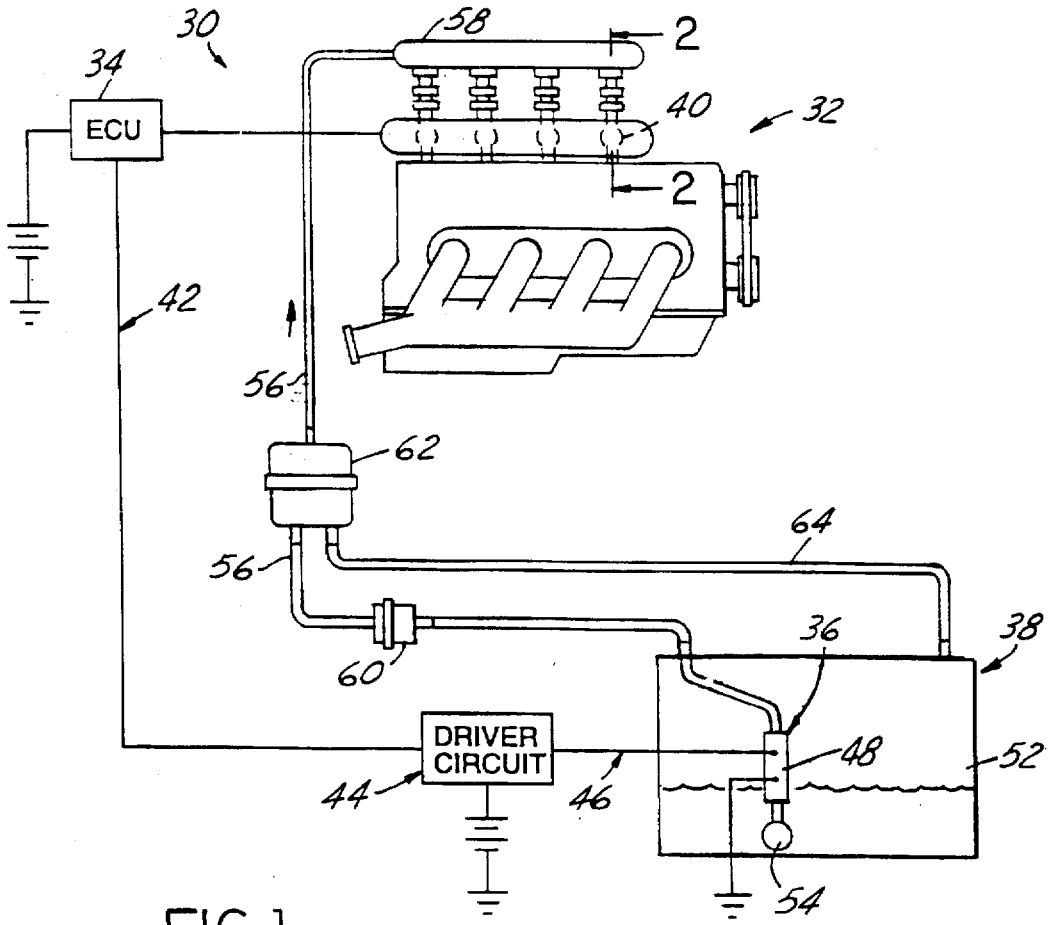
FIG. 1 is a schematic diagram of a fuel delivery system in accordance with one presently preferred embodiment of the invention.
Figure 2:
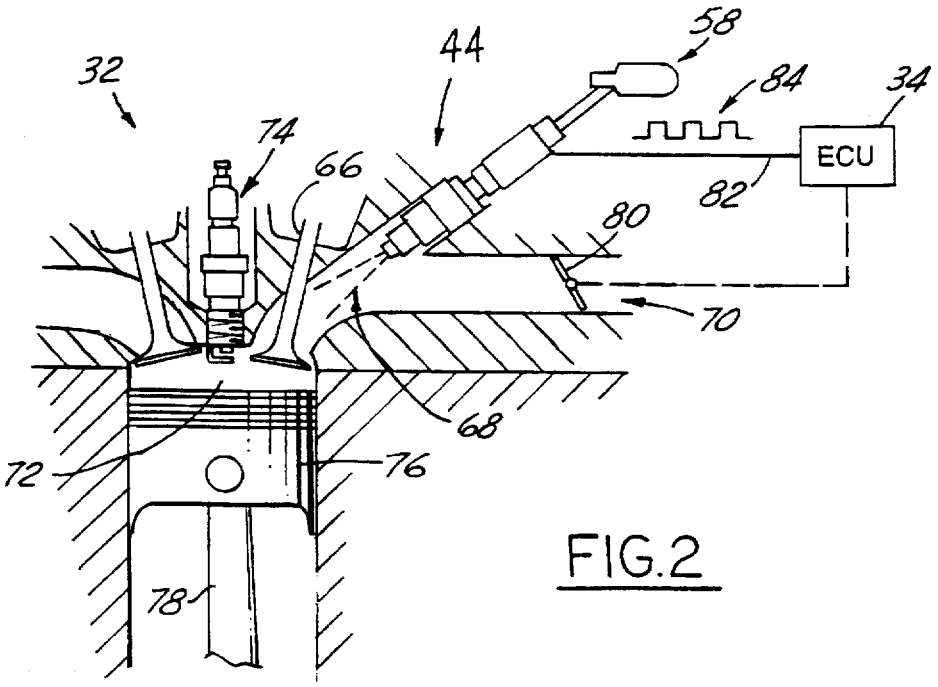
FIG. 2 is a partial sectional view of an internal combustion engine taken along line 2—2 of FIG. 1.

FIGS. 1 & 2 illustrate a fuel delivery system 30 for an internal combustion engine 32 utilizing an engine control unit (ECU) 34 that communicates with the engine 32 to control operation of a fuel pump 36 delivering fuel from a fuel supply 38 to a plurality of fuel injectors 40 of the engine 32 for directly controlling fuel pump output to supply at least as much fuel to the injectors 40 as is being demanded by the engine 32. The ECU 34 monitors actual engine operation and generates an electrical fuel pump control signal 42, corresponding to engine fuel demand, that is received by a fuel pump driver circuit 44 which provides electrical power 46 to the fuel pump to controllably power an electric motor 48 of the pump 36 in response to the fuel pump control signal 42. Advantageously, the fuel pump output is controlled to provide sufficient fuel to the engine 32 while minimizing electrical power usage of the fuel pump 36. Further advantageously, minimizing pump electrical power consumption enables use of a fuel delivery system 30 of this invention with systems designed for use without a battery.

The fuel pump 36 in FIG. 1 is an electric motor gear rotor or turbine fuel pump and is shown installed inside a fuel tank 52 that contains fuel for being supplied to the engine 32. If installed inside the tank 52, the pump 36 can be carried by a bracket (not shown) or received in an in-tank reservoir (also not shown). However, a fuel delivery system 30 of this invention also contemplates that the fuel pump 36 may be positioned outside the tank 52, such as between the engine 32 and tank 36, in the fuel rail 58, or in a vapor separator (not shown) such as for marine applications. Examples of some of these types of aforementioned fuel pump installations are disclosed in U.S. Pat. Nos. 5,368,001, 5,263,459, 5,170,764, 5,038,741, 5,096,391, and 4,893,647, also assigned to the assignee hereof and incorporated by reference herein.

To prevent particulate sediment in the fuel in the tank 52 from being pumped from the tank 52 and damaging the pump 36 or fouling any fuel injector 40, a filter sock or bag 54 enshrouds the fuel inlet of the pump 36. To the extent thus far disclosed, pump 36 is similar to those disclosed in U.S. Pat. Nos. 5,149,252, and 5,122,039, assigned to the assignee hereof, incorporated by reference herein, and to which reference may be had for more detailed background discussion of such pump structure and operation.

As is shown in FIGS. 1 & 2, the pump 36 supplies fuel to a conduit or fuel line 56 that is connected to a fuel rail 58 at the engine 32 that enables fuel to be distributed to each injector 40 during engine operation. Preferably, to further prevent fine dirt and other smaller size particulate matter from reaching any fuel injector 40, there is a fuel filter 60 downstream of the fuel pump 36.

Preferably, during engine operation, the fuel pump 36 provides fuel to each injector 40 under a pressure of at least twenty pounds per square inch (PSI). To maintain adequate fuel pressure at each injector 40 so each injector 40 precisely meters sufficient fuel to satisfy engine fuel demand and for efficient engine operation, the fuel line 56 has a pressure regulator 62 downstream of the fuel pump 36. So that the pressure regulator 62 always provides sufficient fuel to each injector 40 at the desired pressure for proper injector operation, even in times of heavy demand, the ECU 34 causes the pump 36 to preferably supply an amount of fuel to the pressure regulator 62 in excess of that being demanded by the engine 32.

The fuel delivery system 30 illustrated in FIG. 1 has a return 64 extending from the pressure regulator 62 to the fuel tank 52 so that excess fuel supplied by the pump 36 can be returned to the tank 52. Although not shown, the fuel return could be used to return excess fuel to a vapor separator (not shown), if the engine is an outboard engine used for marine applications, or the return could extend from the fuel rail 58 to the tank 52 to return excess fuel. Alternatively, a returnless fuel injection system may also be used. If a returnless system is used, preferably the fuel pump has a pressure relief valve for returning excessively pressurized fuel from the pump back into the fuel tank. Such a fuel pump is disclosed in U.S. Pat. No. 5,248,223, the disclosure of which is hereby incorporated by reference.

As is shown more clearly in FIG. 2, during engine operation and while an intake valve 66 of an engine cylinder 72 is in an open position during the intake stroke of the cylinder 72, a metered charge 68 of fuel is sprayed from an injector 40 while it is open and the fuel mixes with air entering the engine 32 through the intake manifold 70. This air-fuel mixture enters the cylinder chamber 72 and is compressed and ignited by a spark emitted by a spark plug 74 after the intake valve 66 closes. Pressure within the cylinder chamber 72 dramatically increases upon ignition exerting a force against an engine piston 76 received in the cylinder 72. This force is transmitted through a piston rod 78 to a crank (not shown) that outputs power from the engine 32 to an external component (also not shown) such as a vehicle transmission, lawn mower blade, outboard engine propeller, snowmobile track, chain saw chain, weed whip cutting line or another similar component.

Although a small displacement four-stroke engine is shown in FIG. 2, having an intake stroke every other engine revolution, a fuel delivery system 30 of this invention can also be used with a two-stroke fuel injected internal combustion engine, having an intake or suction stroke every engine revolution, to vary fuel pump operation in response to engine fuel demand for reducing electrical power used by the fuel pump 36. As such, it is preferred that the fuel delivery system 30 of this invention can be used with fuel injected two-stroke and four-stroke internal combustion engines.

Engine Control Unit

The engine control unit (ECU) 34 monitors engine operation to determine engine fuel demand for varying and controlling operation of the fuel pump 36 to make at least as much fuel available to the engine 32 as will be consumed by the engine 32 for closely matching pump operation to fuel demand thereby increasing pump efficiency and minimizing electrical power usage of the pump 36. During engine operation, the ECU 34 determines engine fuel demand preferably by sensing engine speed and sensing or approximating the amount of air entering the engine 32.

Preferably, engine fuel demand is determined by the ECU 34 by sensing the appropriate engine operating parameters and selecting the appropriate engine fuel demand or fuel injector opening duration, based on the value of these parameters, from an engine control map accessible by the ECU 34 through its software. Preferably, the engine control map is empirically determined through routine experimentation and testing and is stored in the ECU 34, such as in an erasable programmable read only memory (EPROM) or another such storage device that is accessible by the ECU 34.

Additionally, other engine operating parameters can also be sensed or monitored by the ECU 34, such as water temperature, ambient air temperature, and engine ignition 74, for adjusting engine operation as well as determining and/or adjusting engine fuel demand. For example, the ECU 34 may adjust engine operation by monitoring engine combustion by communicating with the spark plug 74 and engine fuel demand may based in part on any such engine operation adjustment made.

Engine fuel demand is used by the ECU 34 to control fuel pump operation and to control operation of each fuel injector in metering the appropriate amount of fuel to satisfy demand. The ECU 34 controls fuel injector operation for controlling how much fuel that each injector 40 should mix with air entering its engine cylinder chamber 72 by determining how long each injector 40 should remain open during its intake stroke of engine operation (shown in FIG. 2) so that a proper air-fuel mixture is achieved for efficient engine operation. Since the principles of the construction, use and operation of the fuel delivery system 30 of this invention are the same for single or multi-cylinder internal combustion engines, only a small displacement, single cylinder engine will be further discussed in more detail.

Preferably, for small engine applications, the ECU 34 communicates with the engine 32 to sense the position of its throttle 80, as is shown in FIG. 2, for determining how much air is entering the engine 32, and communicates with an engine speed sensor (not shown) to sense engine speed, all for use in determining engine fuel demand. Alternatively, to sense the mass of airflow entering the engine 32, the ECU 34 can communicate with an airflow sensor or a mass airflow sensor, such as a hot-wire or hot-film mass airflow sensor, in determining fuel demand. For example, engine speed can be sensed by the ECU 34 communicating with a sensor such as a variable reluctance sensor that is in operable communication with the engine flywheel. Alternatively, engine speed may be sensed by communicating with the ignition coil of the engine or through another engine speed sensor.

The ECU 34 uses engine fuel demand to formulate a fuel injector control signal 82 and thereafter sends the signal 82 to the injector 40 for controlling the duration of time the injector 40 stays open dispensing fuel during the intake stroke of the engine 32 so that the proper amount of fuel is dispensed into the airstream entering the cylinder 72. The signal 82 preferably takes the form of a pulse width modulated signal 84, such as is depicted in FIG. 2, with the injector 40 staying open for a duration of time during the intake stroke corresponding to the width of the pulse of the signal 84 sent from the ECU 34 to the injector 40. This is also shown in block schematic form in FIGS. 3 & 4.

Advantageously, also in this manner, the fuel pump control signal 42 can be formulated at least as quickly as the fuel injector control signal 82 and, preferably, can be formulated and communicated to the fuel pump 36 before delivering the fuel injector control signal 82 to the fuel injector 40, for earlier and more precisely varying fuel pump output to more closely match engine fuel demand. As such, fuel pump operation can be more quickly varied to react to large changes in fuel demand, such as during wide open throttle (WOT) or substantially full load engine operating conditions, enabling the amount of excess fuel that must be supplied at virtually all other times of engine operation to handle such changes in fuel demand to be minimized significantly decreasing pump power usage.

Preferably, the fuel pump control signal 42 is formulated so that the fuel pump 36 will supply at least as much fuel to the fuel injector 40 as the ECU 34 has determined will be consumed by the engine 32. Preferably, the ECU 34 formulates the fuel pump control signal 42 by first determining how much fuel the injector 40 will dispense into the engine cylinder 72 during an upcoming intake stroke of engine operation and multiplies this value by the engine speed to determine the approximate volumetric flow rate of the fuel that will be used by the engine 32.

If desired, the ECU 34 can formulate the fuel pump control signal 42 after or upon the occurrence of a certain number of engine revolutions, a certain number of intake strokes of engine operation, a fixed period of time, or a desired angular displacement of crankshaft rotation. The number of engine revolutions, intake strokes, time, or amount of rotation between determining the fuel pump control signal 42 may vary depending upon engine application, type and speed, as well as other factors.

Preferably, for a multi-cylinder engine, in determining the fuel pump control signal 42, to determine how much fuel will be dispensed by each injector 40 during each upcoming intake stroke of each injector for a preferably predetermined number of engine revolutions, the ECU 34 sums the duration of time that each injector 40 is to stay open during its intake stroke. Preferably, this also corresponds to the sum of how much time the ECU 34 will instruct each fuel injector 40 to stay open through the injector control signal 82 sent by the ECU 34 for each engine intake stroke for the predetermined number of engine revolutions. To provide even quicker response, the ECU 34 can determine engine fuel demand at smaller increments of engine operation, such as preferably a fraction of an engine revolution, or a fixed period of time of engine operation independent of engine revolutions.

Therefore, since the size of the fuel injector 40 is known and the pressure of the fuel at the injector 40 is regulated and also preferably known, at least within relatively strict limits, the volume of fuel that will be needed by the engine 32 and dispensed by the injector 40 can be determined by the ECU 34 since it determines how long the injector 40 will stay open dispensing fuel during its intake stroke. Therefore, engine fuel demand is a function of the duration of time that the ECU 34 calculates that the fuel injector 40 is to stay open dispensing fuel during each intake stroke of engine operation.

If the fuel injector control signal 82 is pulse width modulated, the ECU 34 can utilize this signal to determine how much fuel will be dispensed by summing the amount of time the injector 40 will be open during the upcoming intake stroke and thereby at least substantially simultaneously formulate the fuel pump control signal 42 so that it controls pump operation to at least replace the fuel that will be consumed during that intake stroke. If the fuel injector signal 82 is pulse width modulated, the ECU 34 can determine the fuel pump control signal 42 by summing the calculated width of the control pulses that will be sent to each fuel injector 40 during its upcoming intake stroke to determine the duration of time the injectors 40 will be open dispensing fuel. Alternatively, the ECU 34 can independently use the engine fuel demand information to determine the fuel pump control signal 42.

Preferably, the ECU 34 generates the fuel pump control signal 42 based upon the following equation:

$$\text{Fuel Pump Control Signal} \simeq (\text{Engine Speed})*(\text{Fuel Duration})*K$$

where:

Engine Speed is the speed of the engine 32 during the engine revolution or revolutions or intake strokes for which the fuel pump control signal 42 is being calculated and, preferably, is in revolutions per minute;

Fuel Duration is how long the fuel injectors 40 will stay open during the desired time period of fuel pump control signal determination; and K is a constant to ensure that the fuel pump control signal 42 causes the fuel pump 36 to supply more fuel than is being demanded by the engine 32.

Preferably, K, is chosen to ensure that the fuel pump 36 supplies excess fuel (ie. more fuel than demanded by the engine) so that the pressure regulator 62 maintains adequate fuel pressure at each fuel injector 40. Preferably, K, is greater than unity and is chosen so that the fuel pump 36 supplies at least five-to-ten percent more fuel than demanded by the engine 32 to maintain adequate fuel pressure at each injector 40 and make available to the engine 32 sufficient excess fuel to meet fuel demand should fuel demand suddenly rise. However, K, may be greater or less than five-to-ten percent depending upon the engine type, engine application, fuel pump size and type and other design criteria. For example, K, may be selected or empirically determined based upon the type and size of fuel pump and intended engine application so that a specific desired amount of excess fuel is supplied to the engine during operation. Preferably, K, is determined by calibrating the fuel delivery system 30 by monitoring fuel flow to the injectors 40 and varying K until the fuel pump 36 is delivering the desired amount of fuel in excess of the fuel required by the engine 32.

Fuel Pump Driver

The fuel pump driver 44 provides electrical power 46 to the motor 48 of the fuel pump 36 in response to the fuel pump control signal 42 provided to the driver 44 by the ECU 34. Preferably, the fuel pump driver 44 provides electrical power 46 to the fuel pump 36 in proportion to the fuel pump control signal 42 to vary the duty cycle of fuel pump operation in response to the fuel requirements of the engine 32 as communicated to it by the fuel pump control signal 42. Typically, during normal engine operation, the fuel pump driver 44 applies an electrical potential to the fuel pump 36 of preferably between twelve to fifteen volts.

Figure 3:
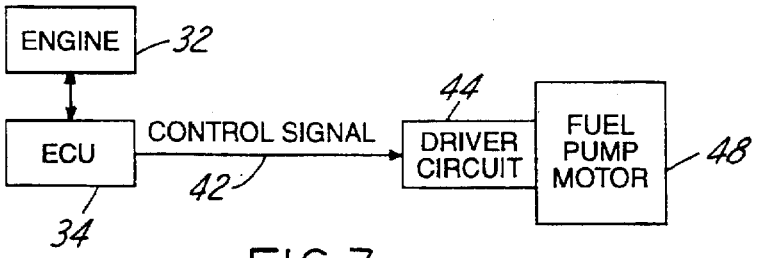
FIG. 3 is a block schematic diagram of the fuel delivery system of FIG. 1.
Figure 4:
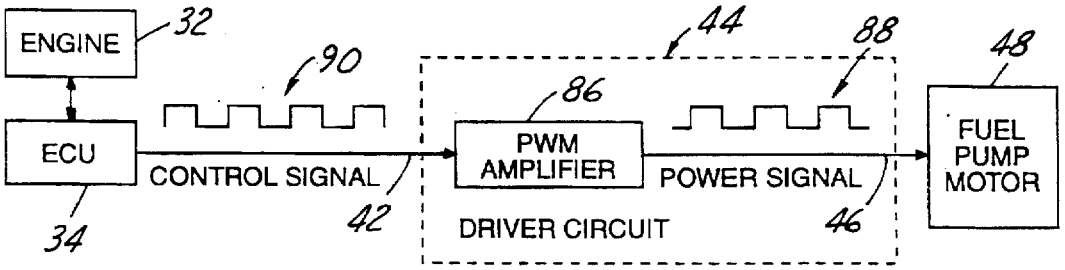
FIG. 4 is a block schematic diagram of the fuel delivery system of FIG. 1 illustrating in more detail a preferred construction and arrangement of a fuel pump driver for controllably providing electrical power to the fuel pump.

As is depicted in FIGS. 3 & 4, the fuel pump driver 44 is preferably located nearby the fuel pump 36 to minimize the distance the electrical pump power signal 46 must travel to reach the motor 48 for minimizing the generation of electromagnetic interference during operation as well as minimizing the susceptibility of the signal to electromagnetic and radio frequency interference from other sources. Preferably, the fuel pump driver 44 is carried by the pump 36.

As is shown more clearly in FIG. 4, the fuel pump driver 44 preferably has a pulse width modulated signal amplifier 86 for generating a pulse width modulated fuel pump power signal 88 and delivering the power signal 88 to the fuel pump motor 48 for driving the pump 36. Preferably, the number and width of pulses during each unit of time of operation is proportional to the fuel pump control signal 42 received from the ECU 34 so that the duty cycle of pump operation is accurately controlled in response to the fuel pump control signal 42 thereby also accurately controlling fuel flow to the engine 32. Therefore, the pulse width modulated fuel pump power signal 46 is a duty cycle signal that controls operation of the fuel pump 36 in response to the fuel pump control signal 42. Preferably, the fuel pump control signal 42 is also a pulse width modulated signal 90 that controls the duty cycle of pump operation by controlling the power signal 88 issued by the fuel pump driver 44 to the pump motor 48.

To ensure that the fuel pump 36 is always running to avoid any time lag in fuel delivery associated with overcoming inertia of the pump components during an increase in fuel demand and to ensure that there is excess fuel being supplied for the injectors 40 to handle sudden increases fuel demand, after being calculated by the ECU 34, the control signal 42 is automatically set by the ECU 34 so that the pump 36 preferably operates at a minimum duty cycle should the calculated fuel pump control signal equation previously discussed produce a result less than a minimum signal limit that would otherwise cause the pump 36 to operate at less than the minimum duty cycle. Preferably, the ECU 34 continually compares the calculated fuel pump control signal value to the minimum duty cycle limit and sets the fuel pump control signal 42 equal to the minimum duty cycle limit should the calculated result be less than the minimum limit. Therefore, for example, during periods of sufficiently low fuel demand, the control signal 42 is preferably set to cause the fuel pump 36 to operate at a duty cycle of preferably fifty percent.

However, this minimum duty cycle limit may be adjusted upwardly or downwardly depending upon the size and type of fuel pump as well as other operating factors that may need to be empirically determined. For example, future fuel pump developments may enable gear-rotor type fuel pumps to efficiently operate at duty cycles of much less than fifty percent. For turbine-type fuel pumps, the minimum duty cycle can be considerably lower; as low as a thirty percent duty cycle or lower.

Conversely, the ECU 34 will set the fuel pump control signal 42 to that which will cause the pump 36 to operate at a one-hundred percent duty cycle should the calculated control signal result (see equation above) produce pump operation at greater than one-hundred percent duty cycle for preventing too large of a power signal 46 to be sent to the pump 36. Otherwise, if the calculated control signal result would produce pump operation between a fifty and one-hundred percent duty cycle the fuel pump control signal 42 is set equal to the calculated value. After calculation and, if necessary, duty cycle adjustment, the fuel pump control signal 42 is applied to the fuel pump driver 44 causing the driver 44 to operate the pump 36 at a duty cycle set by the control signal 42.

Second Preferred Embodiment

Figure 5:
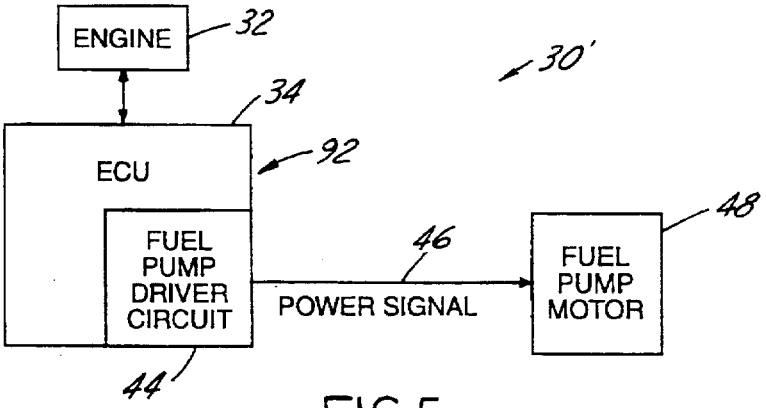
FIG. 5 is a block schematic diagram of a fuel delivery system in accordance with a second preferred embodiment of the invention.
Figure 6:
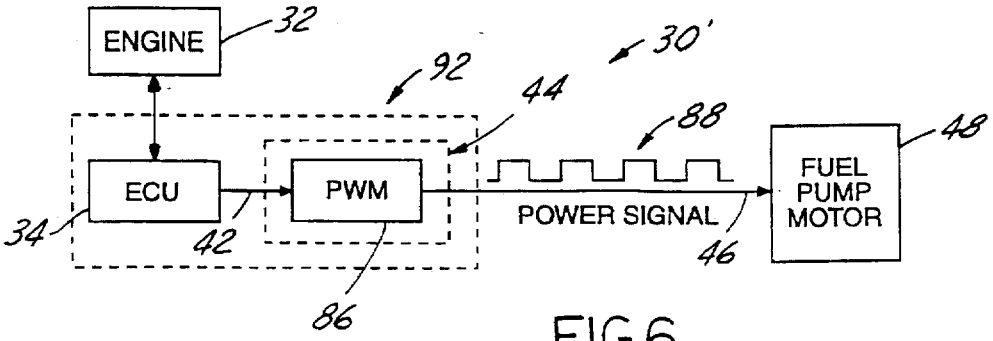
FIG. 6 is a block schematic diagram of the fuel delivery system of FIG. 5 illustrating in more detail a preferred construction and arrangement of an engine control unit and fuel pump driver.

FIGS. 5 & 6 illustrate a second preferred embodiment of a fuel delivery system 30' of this invention. Fuel delivery system 30' is the same as the fuel delivery system 30 shown in FIGS. 1, 3 & 4, except that the fuel pump driver 44 is combined with the ECU 34 in a single unitary package 92, such as a circuit board module having a common circuit board or the like, to minimize the number of parts of the fuel delivery system required for assembly. Preferably, the fuel pump power signal 46 is delivered to the fuel pump motor 48 using coaxial cable to minimize pickup and generation of electromagnetic interference. As is shown more clearly in FIG. 6, the fuel pump control signal is preferably delivered from the ECU 34 directly to the fuel pump driver 44. Preferably, the fuel pump driver 44 has a pulse width modulated amplifier 86 to provide a pulse width modulated fuel pump power signal 88 to drive the motor 48 of the fuel pump 36.

Use and Operation

Figure 7:
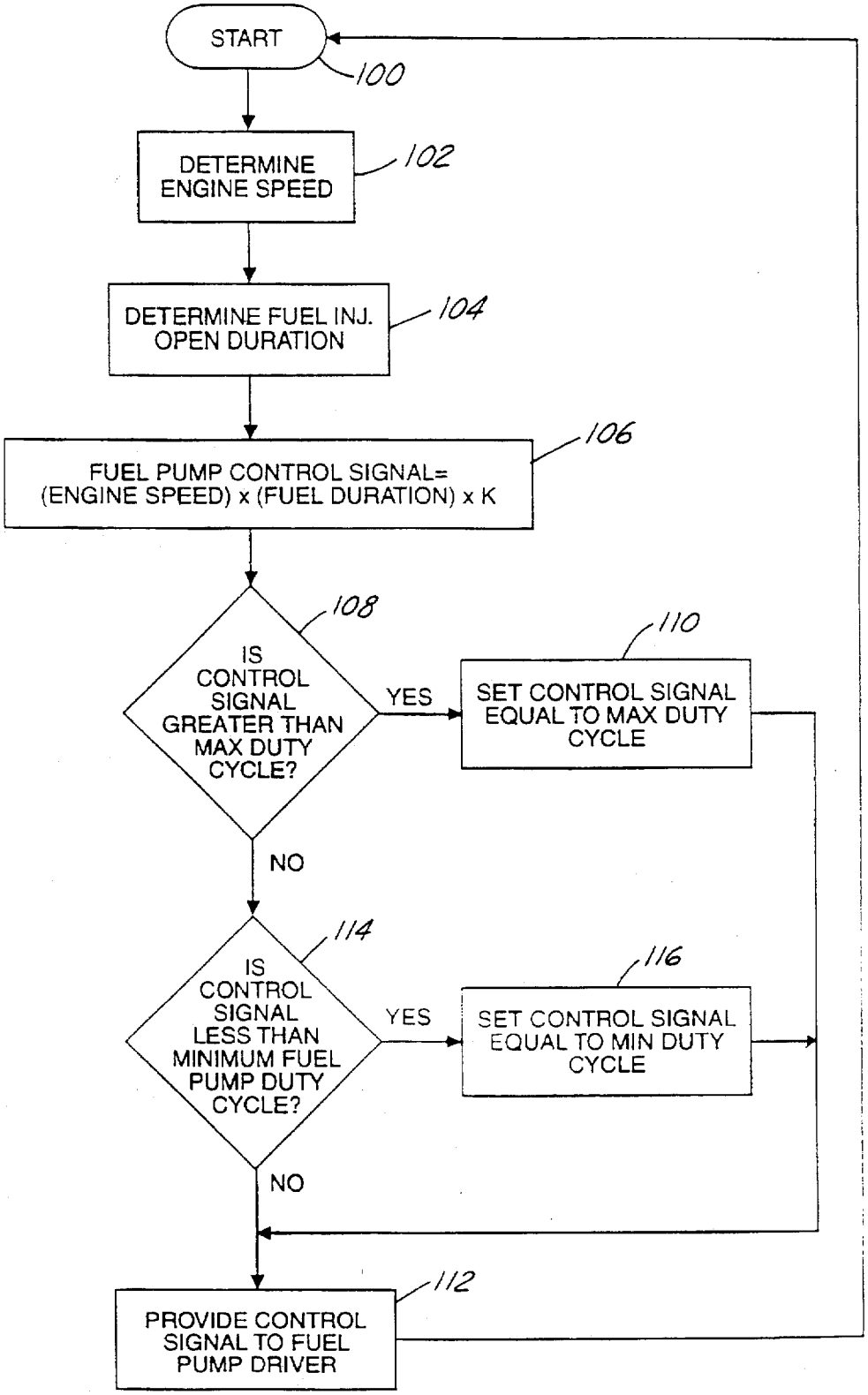
FIG. 7 is a flowchart diagram illustrating operation of the fuel delivery system of this invention.

In use and operation of the fuel delivery system of this invention, as is shown by the flowchart diagram in FIG. 7, at startup 100, during a revolution of engine operation and preferably for each or every other revolution of, respectively, two-stroke or four-stroke engine operation, the ECU 34 determines the engine speed 102 and the duration of time each fuel injector is to stay open during the engine revolution 104 by determining fuel demand. Preferably, the ECU 34 determines fuel demand by reading the position of the throttle 80 and sensing engine speed.

Upon determining engine speed and fuel demand, the fuel pump control signal 42 is calculated using the previously discussed equation 106:

$$\text{Fuel Pump Control Signal} \simeq (\text{Engine Speed})*(\text{Fuel Duration})*K$$

If the calculated fuel pump control signal would produce a pump duty cycle that is greater than the maximum duty cycle 108 of the fuel pump 36, preferably a one-hundred percent duty cycle, the fuel pump control signal 42 is set so that the pump 36 operates at the maximum duty cycle and this signal 42 is applied 112 to the fuel pump driver 44 causing the pump 36 to operate at the maximum duty cycle. If the calculated fuel pump control signal would produce a pump duty cycle that is less than a desired minimum duty cycle 114 of the pump 36, such as a fifty percent duty cycle, the fuel pump control signal 42 is set 116 so that the pump 36 operates at the desired minimum duty cycle and this fuel pump control signal is applied 112 to the fuel pump driver 44 causing the fuel pump 36 to operate at the desired minimum duty cycle. Should the calculated fuel pump control signal produce a fuel pump duty cycle between the desired minimum and maximum duty cycle of the fuel pump 36, the fuel pump control signal 42 will be set equal to the calculated value and applied 112 to the fuel pump driver 44 causing the driver 44 to send the corresponding drive signal 46 to the fuel pump 36.

While the present invention has been disclosed in connection with the preferred embodiments thereof, it should be understood that there will be other embodiments which fall within the spirit and scope of the invention and that the invention is susceptible to modification, variation and change without departing from the scope and fair meaning of the following claims.

What is claimed is:

1. A fuel delivery system for a spark ignited internal combustion engine having a fuel injector for dispensing fuel into a cylinder of the engine comprising:

a fuel supply;

an electric fuel pump in fluid flow communication with said fuel supply and responsive to application of electrical energy for delivery of fuel from said fuel supply to the injector of the internal combustion engine;

a pressure regulator in communication with the fuel pump and the injector for supplying fuel to the injector at a substantially constant pressure;

an engine spark ignition system for igniting fuel in the engine cylinder;

an engine electronic control unit;

a device driven by the engine and producing an electric current to power the engine spark ignition system, engine electronic control unit, fuel injector and the electric fuel pump system with the electric current produced by the device during engine startup and idle conditions having insufficient electric power to meet all of these electric power requirements if the electric pump were operated at a preselected maximum duty cycle to deliver a maximum quantity of fuel sufficient to meet the engine maximum fuel consumption demands;

a first sensor of the speed of rotation of the engine;

a second sensor of one of air intake throttle opening position and mass flow rate of intake air entering the engine; and the engine electronic control unit being in communication with the first and second sensors and having first means determining the anticipated engine fuel demand for each injector before it delivers fuel to the engine and for supplying a first control signal to said fuel pump for varying and regulating the quantity of fuel said pump makes available to the fuel injector as a function of and proportional to the quantity of fuel the first means anticipates will be consumed by the engine between a preselected minimum quantity of fuel sufficient for operation of the engine under idle conditions and a preselected maximum quantity of fuel which prevents damage to the electric fuel pump by not exceeding its maximum duty cycle, second means producing a second control signal to control the amount of time each fuel injector stays open for supplying fuel to the engine, and for each fuel intake cycle of each cylinder of the engine the electronic control unit applies the first control signal to the fuel pump at least by the time it applies its associated second control signal to its associated fuel injector to deliver only slightly more fuel than is used by the fuel injector and minimize the electric power required to operate the electric fuel pump at startup, idle and low engine speeds.

2. The fuel delivery system of claim 1 also comprising a fuel pump driver in communication with said engine control unit and in communication with said fuel pump for supplying electrical energy to said fuel pump to power said fuel pump in response to communication by said fuel pump driver with said engine control unit.

3. The fuel delivery system of claim 2 wherein said fuel pump driver is an electrical circuit responsive to a control signal for outputting electrical energy to said fuel pump proportional to said control signal for varying fuel output from said fuel pump in proportion to said control signal and said engine control unit generates said control signal and communicates said control signal to said fuel pump driver for varying and regulating fuel pump operation to make at least as much fuel available to the fuel injector as will be consumed by the engine.

4. The fuel delivery system of claim 3 wherein said control signal generated by said engine control unit is proportional to engine fuel demand determined by said engine control unit.

5. The fuel delivery system of claim 4 wherein said control signal generated by said engine control unit is proportional to engine fuel demand determined by said engine control unit and causes said fuel pump to supply at least five percent more fuel to the injector than demanded by the engine for at least replacing fuel that will be consumed by the engine while supplying adequate fuel to maintain fuel pressure at the injector.

6. The fuel delivery system of claim 4 wherein said engine control unit senses the amount of air entering the engine and senses engine speed for determining engine fuel demand.

7. The fuel delivery system of claim 6 wherein said engine control unit senses engine throttle position and senses engine speed for determining engine fuel demand.

8. The fuel delivery system of claim 6 wherein said engine control unit senses mass airflow of air entering the engine and senses engine speed for determining engine fuel demand.

9. The fuel delivery system of claim 4 wherein said engine control unit determines engine fuel demand by determining how much fuel will be dispensed by the fuel injector during a fixed period of time of engine operation.

10. The fuel delivery system of claim 9 wherein the fuel injector opens for a duration of time during each intake stroke of its cylinder during engine operation for dispensing fuel into the cylinder and said engine control unit determines fuel demand of the engine by multiplying the duration of time the injector will dispense fuel into the engine cylinder during the next intake stroke by the speed of the engine.

11. The fuel delivery system of claim 10 wherein said control signal generated by said engine control unit is proportional to the duration of time the injector will dispense fuel into the engine cylinder during the next intake stroke multiplied by the speed of the engine for varying and regulating fuel pump operation to make at least as much fuel available to the fuel injector as will be consumed by the engine.

12. The fuel delivery system of claim 10 wherein said control signal generated by said engine control unit is proportional to the duration of time the injector will dispense fuel into the engine cylinder during the next intake stroke multiplied by the speed of the engine and multiplied by a constant to ensure that said fuel pump supplies more fuel than demanded by the engine for at least replacing fuel that will be consumed by the engine while supplying adequate fuel to maintain fuel pressure at the injector.

13. The fuel delivery system of claim 12 wherein said constant is determined by calibrating the fuel delivery system by monitoring fuel flow to the engine and varying the value of said constant until said control signal causes said fuel pump to deliver a desired amount of fuel to the injector in excess of that demanded by the engine to at least replace fuel consumed by the engine while maintaining adequate fuel pressure at the injector.

14. The fuel delivery system of claim 12 wherein said constant is chosen so that said fuel pump delivers at least five percent more fuel to the injector than engine fuel demand.

15. The fuel delivery system of claim 3 wherein said electrical energy applied by said fuel pump driver to said fuel pump is an electrical duty cycle signal for controlling the amount of energy applied to said fuel pump during a fixed period of time of fuel pump operation to controllably vary fuel flow from said pump to the fuel injector in proportion to said electrical duty cycle signal from said fuel pump driver and said control signal generated by said engine control unit is compared with a minimum fuel pump operating capacity value and said control signal is set equal to said minimum fuel pump operating capacity value if said generated control signal is less than said minimum value so that said fuel pump driver provides a minimum duty cycle signal to said fuel pump to ensure said fuel pump always delivers a predetermined minimum amount of fuel flow to the fuel injector.

16. The fuel delivery system of claim 15 wherein said control signal generated by said engine control unit is compared with a maximum pump operating capacity value and setting said control signal equal to said maximum pump operating capacity value if said control signal is greater than said maximum value so that said fuel pump driver provides a corresponding maximum duty cycle signal to said fuel pump to ensure said fuel pump never delivers more than a predetermined maximum amount of fuel flow to the fuel injector.

17. The fuel delivery system of claim 16 wherein said minimum pump operating capacity value is that which produces a control signal to said fuel pump driver for providing at least a twenty percent duty cycle signal to said fuel pump so that said fuel pump never operates at less than twenty percent of its fuel pumping capacity.

18. The fuel delivery system of claim 17 wherein said minimum pump operating capacity value is that which produces a control signal to said fuel pump driver for providing a fifty percent duty cycle signal to said fuel pump so that said fuel pump never operates at less than fifty percent of its fuel pumping capacity.

19. The fuel delivery system of claim 16 wherein said maximum control signal is an electrical control signal which causes said fuel pump driver to provide a one-hundred percent duty cycle signal to said fuel pump so that said fuel pump never operates at more than one-hundred percent of its fuel pumping capacity.

20. The fuel delivery system of claim 15 wherein said fuel pump includes a direct current pump motor and wherein said fuel pump driver comprises a pulse width modulation amplifier for applying a pulsed direct current electrical signal to said fuel pump motor at a duty cycle that varies relative to said control signal provided by said engine control unit to vary said duty cycle as a function of engine fuel demand.

21. The fuel delivery system of claim 1 also comprising a fuel pump driver in communication with said engine control unit and in communication with said fuel pump for supplying electrical energy to said fuel pump to power said fuel pump in response to communication by said fuel pump driver with said engine control unit and a module for receiving said engine control unit and said fuel injector driver.

22. The fuel delivery system of claim 21 wherein said engine control unit is integral with said fuel pump driver.

23. The fuel delivery system of claim 22 wherein said engine control unit and said fuel pump driver are on the same circuit board.

24. The fuel delivery system of claim 1 also comprising a fuel pump driver in communication with said engine control unit and in communication with said fuel pump for supplying electrical energy to said fuel pump to power said fuel pump in response to communication by said fuel pump driver with said engine control unit and said fuel pump driver being in close proximity to said fuel pump for minimizing the distance said electrical energy must travel to said fuel pump.

25. The fuel delivery system of claim 24 wherein said fuel pump driver is carried on said fuel pump.

26. The fuel delivery system of claim 1 also comprising a fuel pump driver in communication with said engine control unit and in communication with said fuel pump for supplying electrical energy to said fuel pump to power said fuel pump in response to communication by said fuel pump driver with said engine control unit and wherein said fuel pump driver is an electrical circuit responsive to a fuel pump control signal for outputting electrical energy to said fuel pump proportional to said fuel pump control signal for varying fuel output from said fuel pump in proportion to said fuel pump control signal and said engine control unit generates said fuel pump control signal proportional to:

$$\text{Fuel Pump Control Signal} \approx (\text{Engine Speed})*(\text{Fuel Duration})*K$$

and said engine control unit communicates said fuel pump control signal to said fuel pump driver for varying and regulating fuel pump operation to make at least as much fuel available to the fuel injector as will be consumed by the engine.

27. The fuel delivery system of claim 1 wherein between the minimum and maximum quantity of fuel the first means and first control signal causes the fuel pump to actually deliver a quantity of fuel which is not more than about 10% greater than the actual fuel demand of the engine.

28. A fuel delivery system for a spark ignited internal combustion engine having a fuel injector for dispensing fuel into a cylinder of the engine comprising;

a fuel supply;

an electric fuel pump in fuel flow communication with said fuel supply and responsive to application of electric energy for delivery of fuel from said fuel supply to the injector of the internal combustion engine;

an engine spark ignition system for igniting fuel in the engine cylinder;

a pressure regulator in communication with the fuel pump and the injector for supplying fuel to the injector at a substantially constant pressure;

a device driven by the engine and producing an electric current at startup, idle and low engine speeds having insufficient power to meet the power requirements of all of the spark ignition system, fuel injector and the electric fuel pump if operated at a maximum duty cycle to deliver a maximum quantity of fuel;

a first sensor of the speed of rotation of the engine;

a second sensor of one of air intake throttle opening position and mass flow rate of intake air entering the engine; and an engine electronic control unit in communication with the first and second sensors and having first means determining the anticipated engine fuel demand for each injector before it delivers fuel to the engine and for supplying a first control signal to said electric fuel pump for varying and regulating the quantity of fuel said pump makes available to the fuel injector as a function of and proportional to the quantity of fuel the first means anticipated will be consumed by the engine between a preselected minimum quantity of fuel sufficient for operation of the engine under startup, idle and low engine speed conditions and a preselected maximum quantity of fuel which prevents damage to the electric fuel pump by not exceeding its maximum duty cycle, second means producing a second control signal to control the amount of time each fuel injector stays open for supplying fuel to the engine, and for each fuel intake cycle of each cylinder of the engine the electronic control unit applies the first control signal to the fuel pump at least by the time it applies its associated second control signal to its associated fuel injector to deliver only slightly more fuel than is used by the fuel injector and minimize the electric power required to operate the electric fuel pump at startup, idle and low engine speeds.

29. The fuel delivery system of claim 1 wherein the engine spark ignition system, engine electronic control unit and electric fuel pump are not connected to an electric storage battery.

30. The fuel delivery system of claim 28 wherein the engine spark ignition system, engine electronic control unit and electric fuel pump are not connected to an electric storage battery.

* * * * *